US008761635B2

(12) United States Patent
Lee et al.

(10) Patent No.: US 8,761,635 B2
(45) Date of Patent: Jun. 24, 2014

(54) DEVELOPING DEVICE AND IMAGE FORMING APPARATUS HAVING THE SAME

(75) Inventors: Sang Hoon Lee, Suwon-si (KR); Dae Seob Kweon, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 161 days.

(21) Appl. No.: 13/343,890

(22) Filed: Jan. 5, 2012

(65) Prior Publication Data

US 2012/0177407 A1 Jul. 12, 2012

(30) Foreign Application Priority Data

Jan. 12, 2011 (KR) ..... 10-2011-0003016

(51) Int. Cl.
*G03G 15/02* (2006.01)

(52) U.S. Cl.
USPC ..... 399/115

(58) Field of Classification Search
USPC ..... 399/110, 113, 114, 115
See application file for complete search history.

(56) References Cited

U.S. PATENT DOCUMENTS

| | | | | |
|---|---|---|---|---|
| 6,937,834 | B2 * | 8/2005 | Kanno et al. | 399/114 |
| 7,072,603 | B2 * | 7/2006 | Tsuzuki et al. | 399/111 |
| 7,577,378 | B2 * | 8/2009 | Matsui | 399/115 |

* cited by examiner

*Primary Examiner* — Clayton E Laballe
*Assistant Examiner* — Victor Verbitsky
(74) *Attorney, Agent, or Firm* — Stanzione & Kim, LLP

(57) ABSTRACT

A developing device and an image forming apparatus having the same. The developing device includes a space maintaining member separably coupled to an outer surface of a housing thereof. The space maintaining member restricts movement of a holder used to support a charging roller which comes into contact with a photoconductor by pressure of a pressure member, providing use convenience and operation reliability.

17 Claims, 10 Drawing Sheets

DEVELOPING DEVICE AND IMAGE FORMING APPARATUS HAVING THE SAME

CROSS-REFERENCE TO RELATED APPLICATIONS

This application claims the benefit of Korean Patent Application No. 2011-0003016, filed on Jan. 12, 2011 in the Korean Intellectual Property Office, the disclosure of which is incorporated herein by reference in its entirety.

BACKGROUND OF THE INVENTION

1. Field of the Invention

Embodiments of the present inventive concept relate to an image forming apparatus having a developing device to reduce image defects.

2. Description of the Related Art

An image forming apparatus is designed to print an image on a recording medium based on input image signals. Examples of image forming apparatuses include printers, copiers, fax machines, and devices combining functions thereof.

Such an image forming apparatus includes a developing device to feed developer to a photoconductor drum on which an electrostatic latent image has been formed, so as to develop the electrostatic latent image into a visible image.

The developing device is divided into a developer feed unit in which developer is stored and a developing unit in which the electrostatic latent image is developed into a visible image using the developer fed from the developer feed unit.

In the above-described developing device, the developer feed unit and the developing unit may be integrated with each other, or may be separated from each other so as to be detachably attached to each other.

The developing device typically takes the form of a cartridge. Major developing elements including a photoconductor drum, charging roller, cleaning roller, developing roller and feed roller are accommodated in a main body of the developing device in the form of a single process cartridge.

Typically, prior to being mounted within the image forming apparatus, the cartridge-shaped developing device remains in a state in which nips are defined between the photoconductor drum and the charging roller and between the charging roller and the cleaning roller.

That is to say, since the charging roller is under pressure by a pressure member and thus, comes into pressure contact with the photoconductor drum, a surface of the charging roller has a nip indented by a predetermined depth.

SUMMARY OF THE INVENTION

The present general inventive concept provides a developing device to prevent surface deformation of a roller provided therein, and an image forming apparatus having the same.

Additional aspects of the inventive concept will be set forth in part in the description which follows and, in part, will be obvious from the description, or may be learned by practice of the inventive concept.

Embodiments of the present inventive concept provide a developing device which includes a housing, a photoconductor supported by the housing, a charging roller to charge the photoconductor, a holder slidably installed to the housing and serving to support the charging roller, a pressure member to apply pressure to the holder toward the photoconductor, and a space maintaining member separably installed to an outer surface of the housing and having an intervenient piece configured to be fitted between the holder and the housing so as to cause the photoconductor and the charging roller to be spaced apart from each other.

The housing may include an optical path along which beam irradiated from a light scanning device reaches the photoconductor, and the space maintaining member may include a cover to cover an entrance of the optical path.

The charging roller may come into contact with the photoconductor by the pressure of the pressure member when the space maintaining member is separated from the housing.

The holder may include a hook protruding outward from the housing, and the intervenient piece may be fitted between the hook and the housing.

The pressure member may include a compressive coil spring interposed between the housing and the holder.

The intervenient piece may take the form of a plate having a predetermined thickness to adjust a distance between the charging roller and the photoconductor.

The intervenient piece may include an insertion rib extending from the cover, and a slope may be formed at a tip end of the insertion rib.

The hook may include a downwardly inclined introduction guide surface to guide introduction of the insertion rib.

A guide rib may be provided inside the housing such that the holder is slidably coupled to the guide rib, and a stopper may be formed at an end of the guide rib to prevent separation of the holder.

The holder may include a body provided with a shaft seat to support the charging roller, guide grooves formed in opposite sides of the body such that the guide ribs are fitted into the guide grooves, and a hook extending from the body in an opposite direction of the shaft seat, and the intervenient piece may be fitted between the housing and the hook.

The body may include a support boss on which the pressure member is seated and supported, and the pressure member may include a compressive coil spring having one end supported by the support boss and the other end supported by the housing.

The space maintaining member may include a gripper to allow a user to grip the space maintaining member upon coupling or separation thereof.

The housing may include an opening through which a part of the photoconductor is exposed, and the space maintaining member may further include a photoconductor cover to cover the opening.

The holder may include a hook protruding outward from the housing and having a through-hole, and the intervenient piece may be inserted into the through-hole.

The intervenient piece may include a rod member having a circular cross section.

Embodiments of the inventive concept also provide an image forming apparatus which includes a main body, and a developing device separably accommodated in the main body and including a housing in which a photoconductor and a charging roller arranged to come into contact with the photoconductor so as to charge the photoconductor with a predetermined electric potential are accommodated, wherein the developing device includes a holder slidably installed to the housing and serving to support the charging roller, a pressure member to apply pressure to the holder toward the photoconductor, and a space maintaining member separably installed to an outer surface of the housing and having an intervenient piece configured to be fitted between the holder and the housing so as to cause the photoconductor and the charging roller to be spaced apart from each other, and wherein the charging roller comes into contact with the photoconductor by the pressure of the pressure member when the space maintaining member is separated from the housing.

Embodiments of the inventive concept also provide a developing device comprising: a housing; a photoconductor rotatively supported within the housing; a holder assembly to hold a charging roller and slidably supported within the housing to slidably move the charging roller toward and away from the photoconductor, the holder assembly including a portion which extends through a slot in the housing when spaced away from the photoconductor; at least one pressure member disposed between the holder assembly and an inner portion of the housing to press the holder assembly toward the photoconductor such that the charging roller makes contact with the photoconductor; and a space maintaining member comprising an intervening piece which engages with the portion of the holder assembly extending outside of the housing through the slot to prevent the holder assembly from being pressed toward the photoconductor.

BRIEF DESCRIPTION OF THE DRAWINGS

Description of the Drawings

Figure 1:
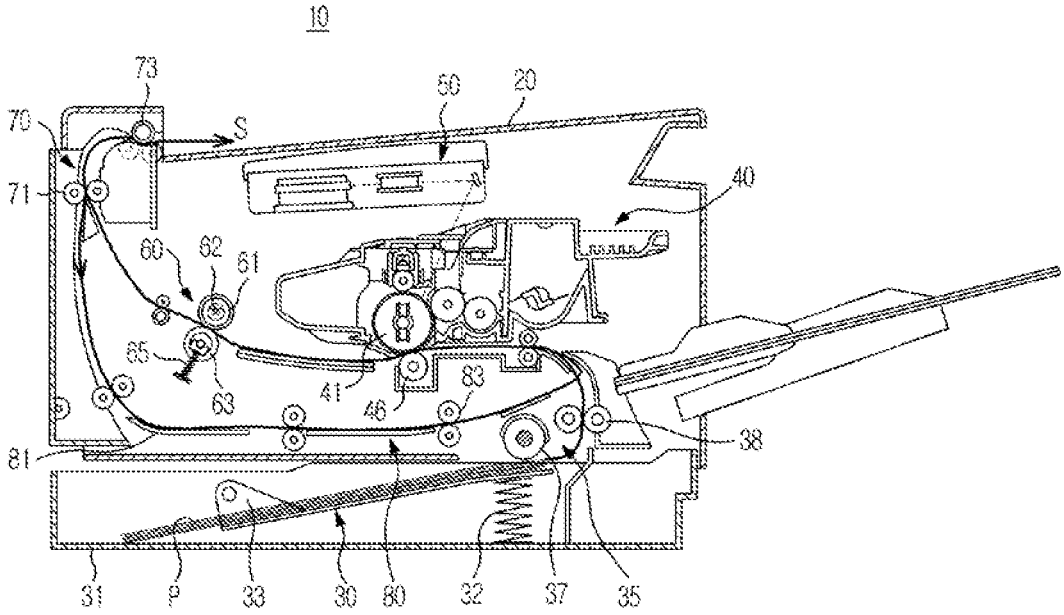
Figure 2:
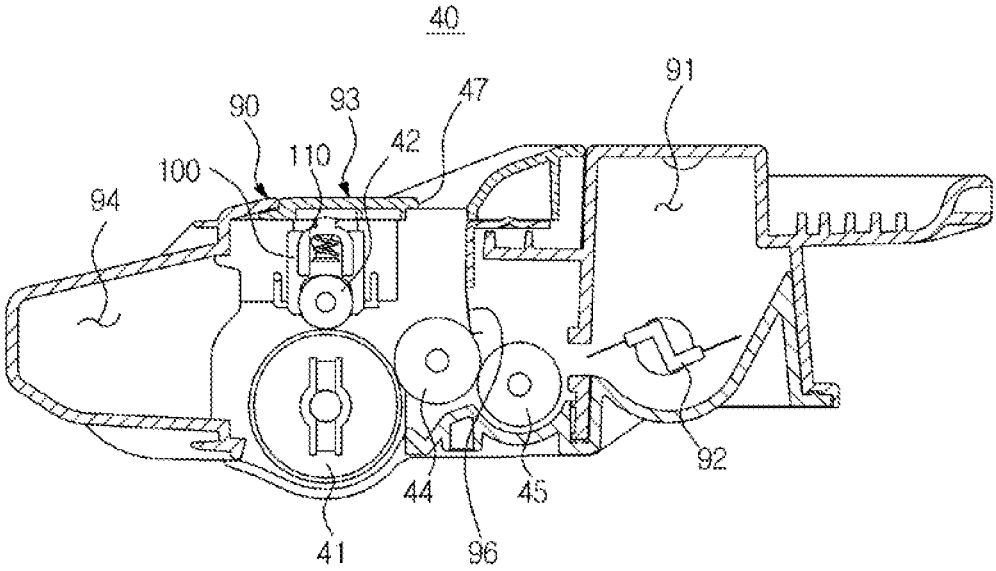
Figure 3:
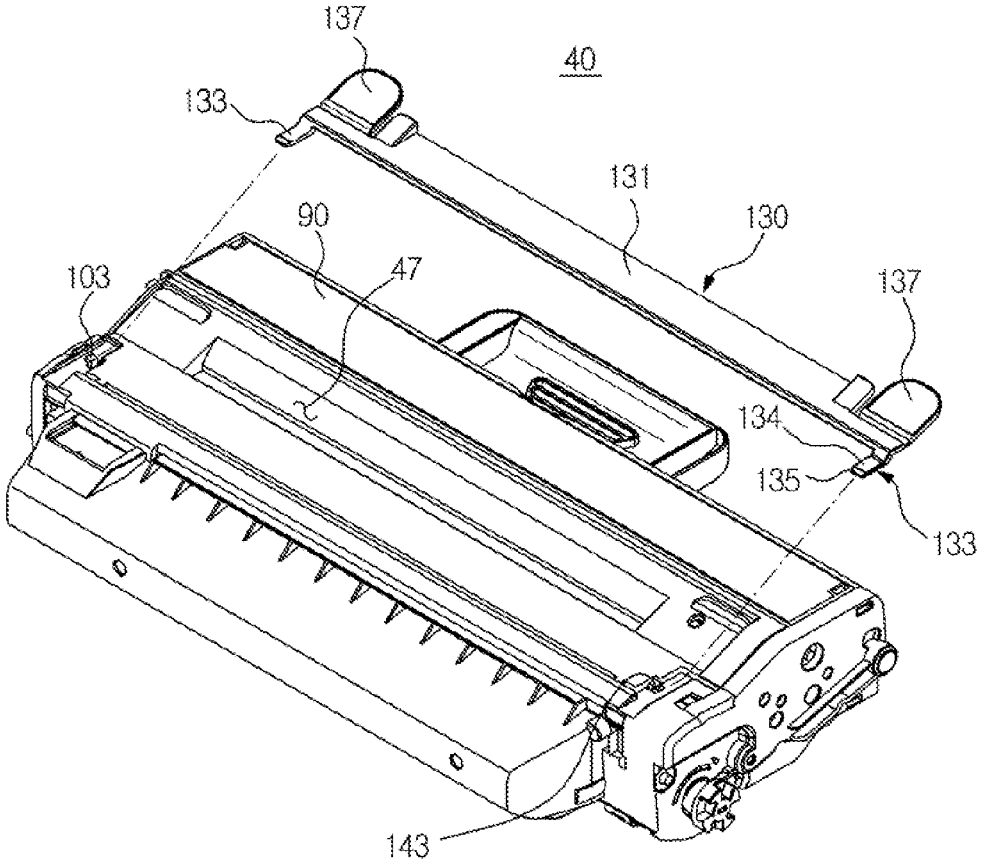
Figure 4:
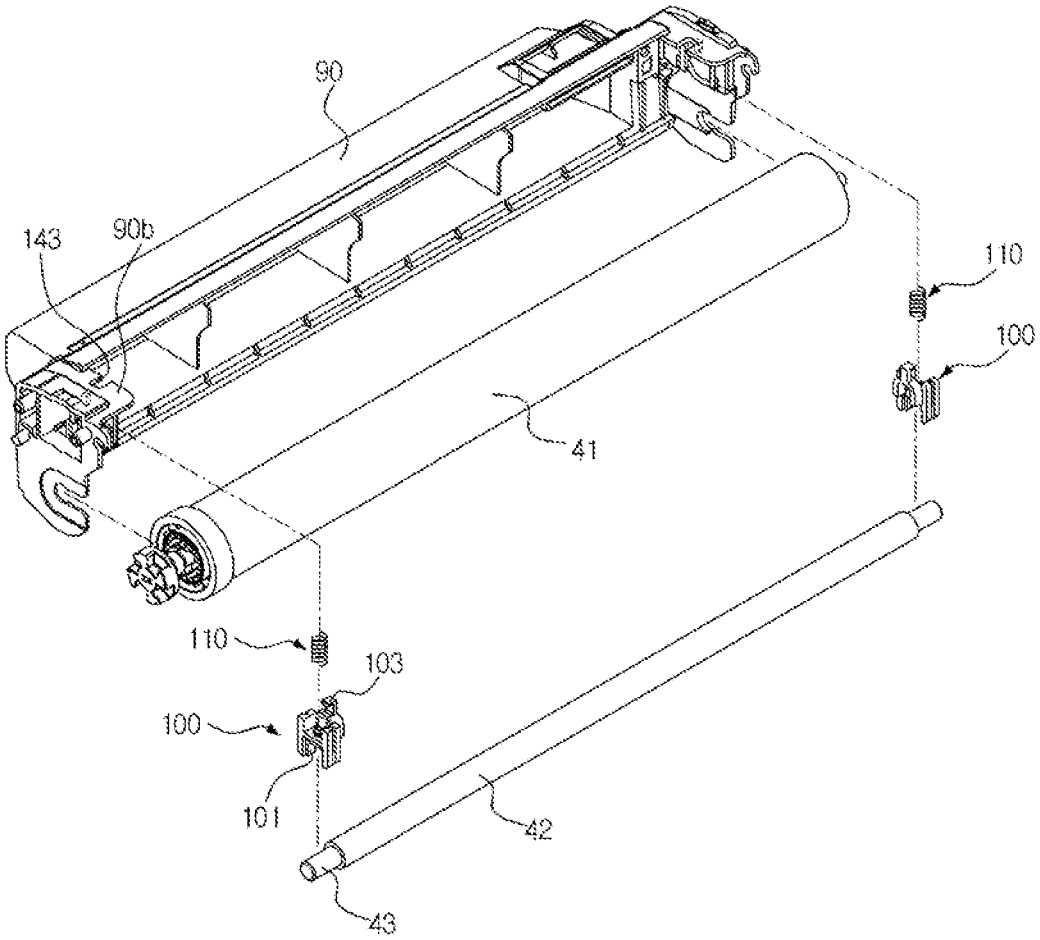
Figure 5:
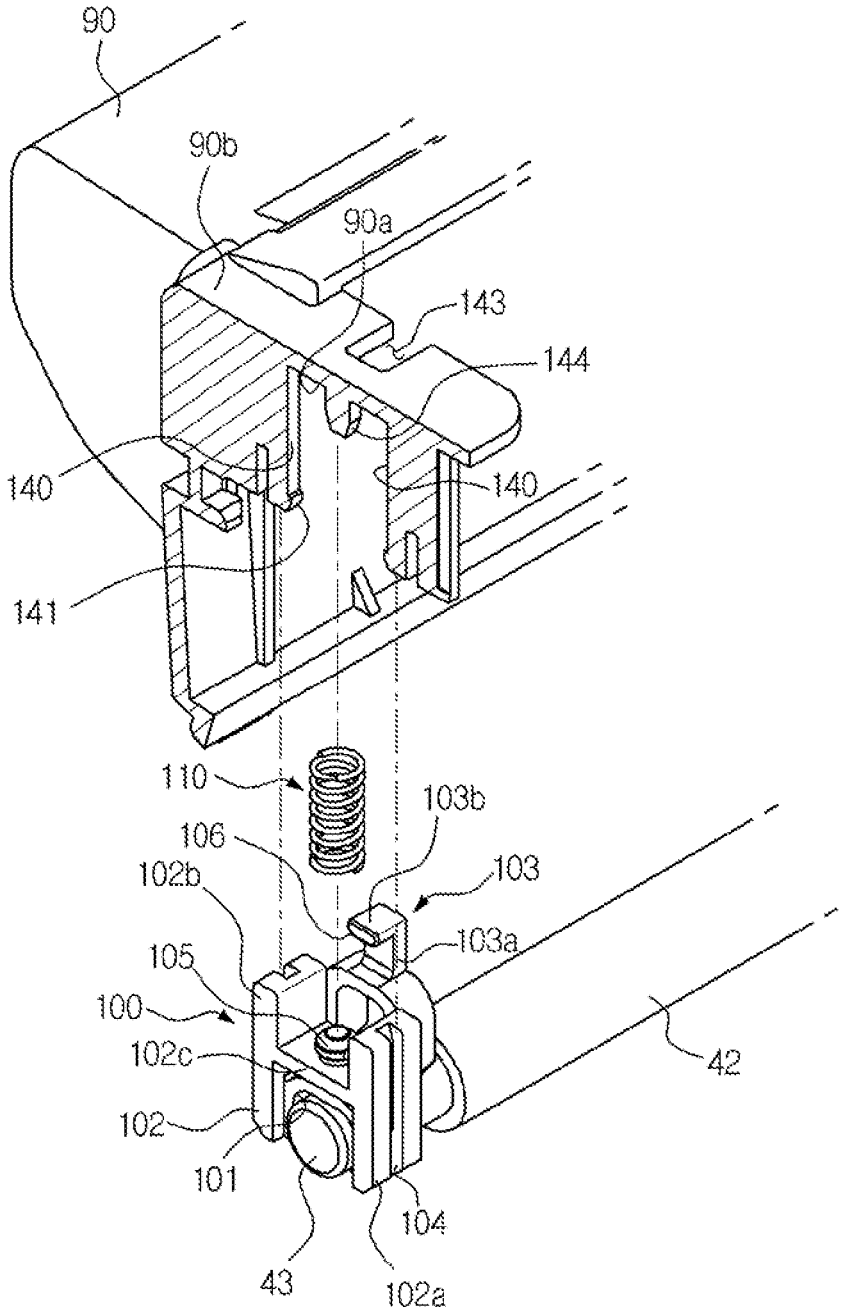
Figure 6:
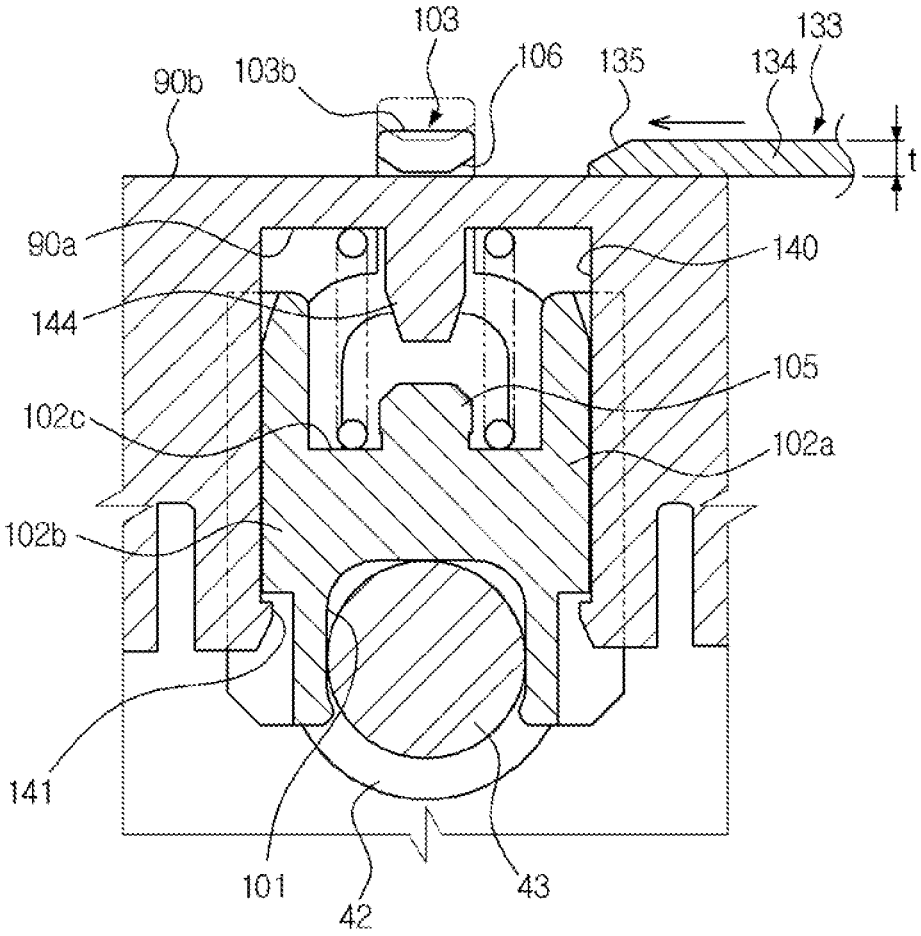
Figure 7:
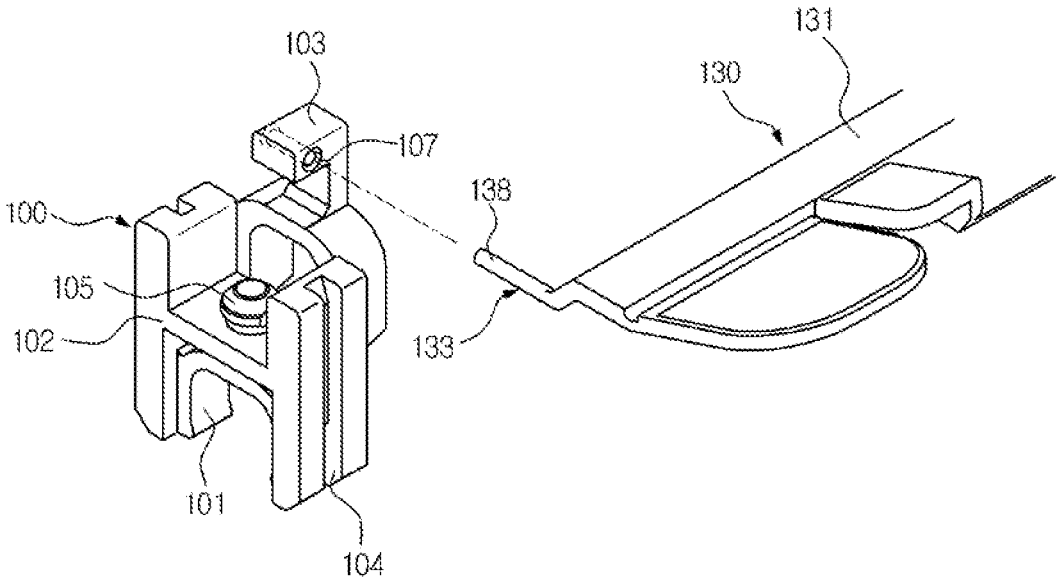
Figure 8:
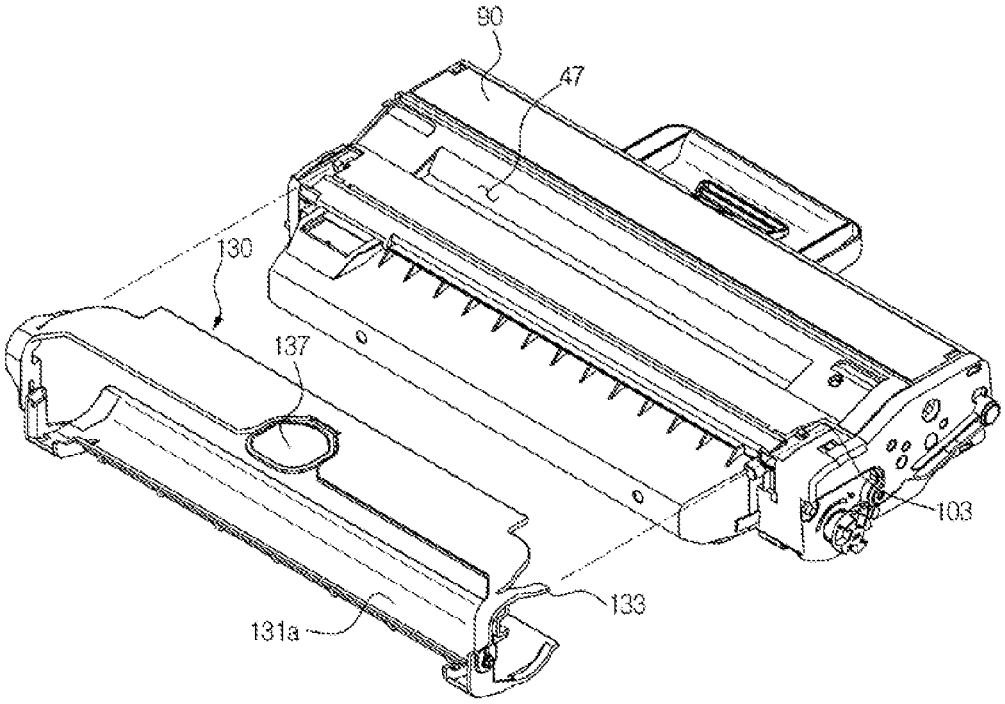
Figure 9:
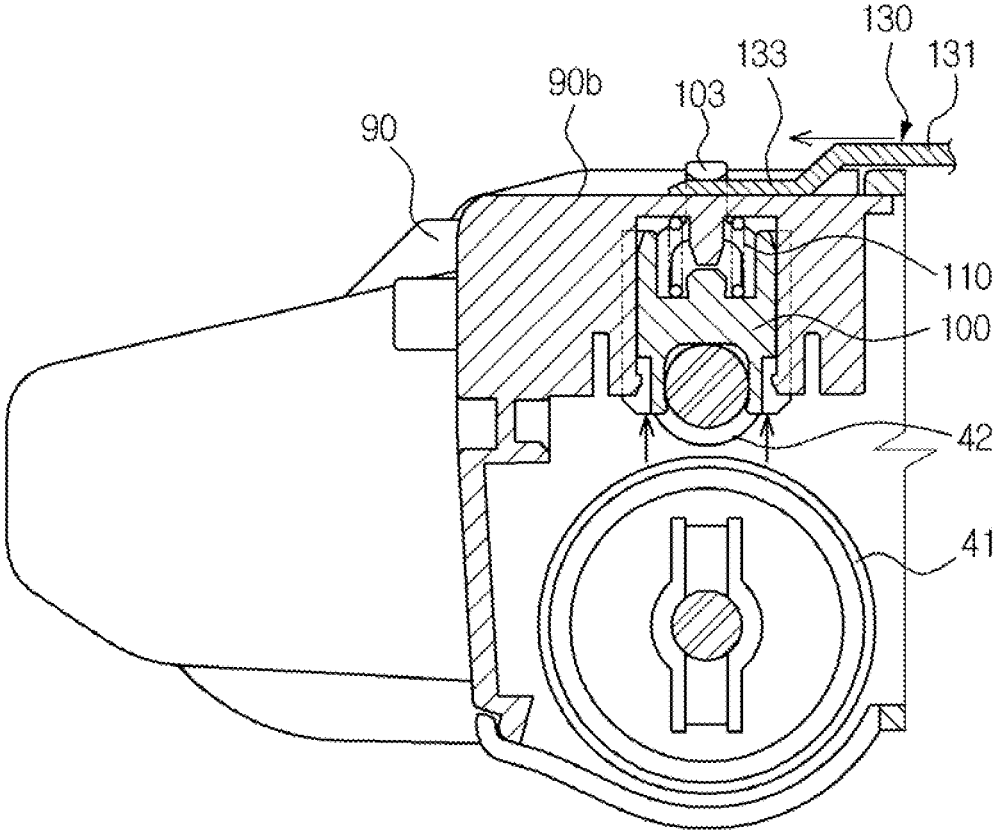
Figure 10:
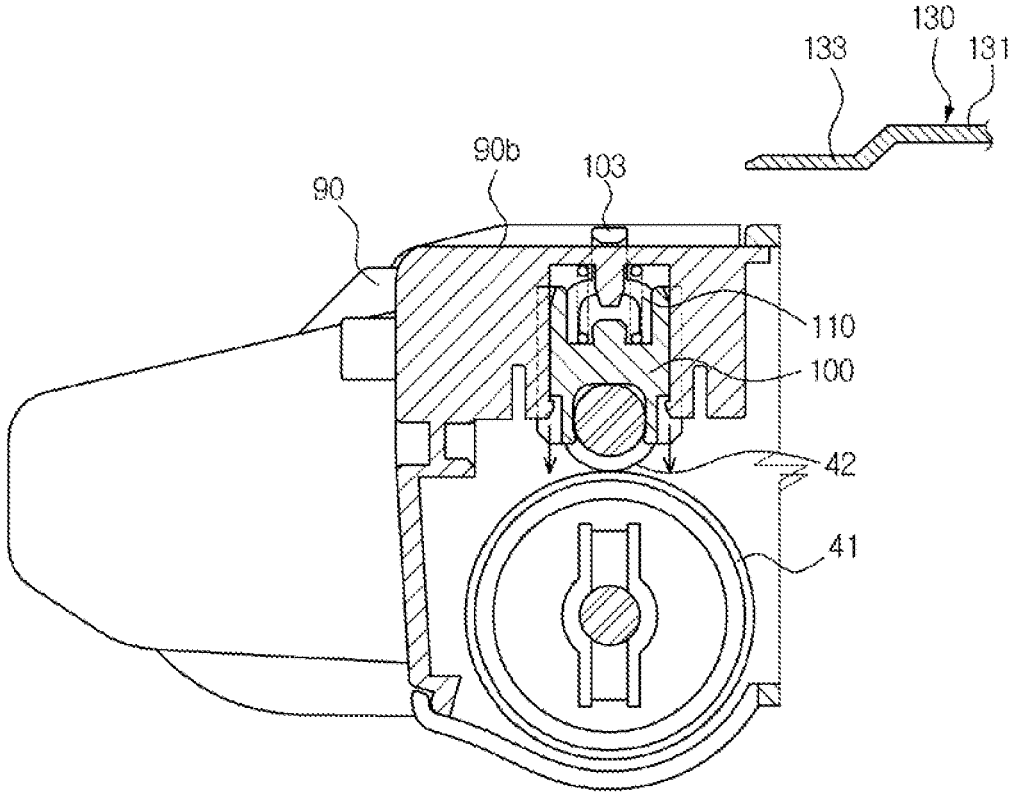

These and/or other aspects and advantages of the present general inventive concept will become apparent and more readily appreciated from the following description of the embodiments, taken in conjunction with the accompanying drawings of which:

FIG. 1 is a sectional view illustrating a configuration of an image forming apparatus in accordance with an embodiment of the present inventive concept;

FIG. 2 is a sectional view illustrating a configuration of a developing device provided in the image forming apparatus in accordance with an embodiment of the present inventive concept;

FIG. 3 is a perspective view illustrating the external appearance of the developing device in accordance with the embodiment of FIG. 2;

FIG. 4 is an exploded perspective view illustrating a part of a developing unit of the developing device housing in accordance with the embodiment of FIG. 2;

FIG. 5 is a partial enlarged view of FIG. 4;

FIG. 6 is an assembled sectional view of FIG. 5;

FIG. 7 is a view illustrating an intervenient piece of a space maintaining member in accordance with another embodiment;

FIG. 8 is a view illustrating a space maintaining member in accordance with a further embodiment;

FIG. 9 is a view illustrating a state in which the space maintaining member is mounted on a developing device housing in accordance with the embodiment of FIG. 8; and FIG. 10 is a view illustrating a state in which the space maintaining member is separated from the developing device housing in accordance with the embodiment of FIG. 8.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a sectional view illustrating a configuration of an image forming apparatus in accordance with an embodiment of the present inventive concept, and FIG. 2 is a sectional view illustrating a configuration of a developing device provided in the image forming apparatus in accordance with the embodiment of FIG. 1.

As illustrated in FIG. 1, the image forming apparatus 10 in accordance with the present embodiment includes a main body 20 defining the external appearance of the image forming apparatus 10, a paper feeding device 30 to store and feed recording media P, a developing device 40 to form an image on the recording medium P fed from the paper feeding device 30, a light scanning device 50 to form an electrostatic latent image on a photoconductor 41 of the developing device 40, a fusing device 60 to fuse a developer image, transferred to the recording medium P, to the recording medium P, a paper discharge device 70 to discharge the recording medium P, on which the image has been completely formed, to the outside of the main body 20, and a double-sided printing device 80 to return the recording medium P, on a surface of which the image has been completely formed, to the developing device 40.

The paper feeding device 30 to store and feed the recording media P is provided in a lower region of the main body 20 and serves to feed the recording media P toward the developing device 40.

The paper feeding device 30 includes a cassette type paper feeding tray 31 in which the recording media P is stored, the tray 31 being separably coupled to the main body 20, and a delivery mechanism 35 to pick up the recording media P stored in the paper feeding tray 31 one by one and deliver the picked-up recording medium P toward the developing device 40.

A knock-up plate 33 may be arranged in the paper feeding tray 31 so as to guide the recording medium P stacked thereon toward the delivery mechanism 35. One end of the knock-up plate 33 is rotatably coupled to the paper feeding tray 31 and the other end of the knock-up plate 33 is supported by a pressure spring 32.

The delivery mechanism 35 may include a pickup member 37 to pick up the recording medium P stacked on the knock-up plate 33 one by one, and a roller type feed member 38 to deliver the recording medium P picked-up by the pickup member 37 toward the developing device 40.

The light scanning device 50 irradiates light corresponding to image information to the photoconductor 41 so as to form an electrostatic latent image on the photoconductor 41.

The fusing device 60 serves to fuse a developer image, formed on the recording medium P, to the recording medium P by applying heat and pressure to the recording medium P having the developer image thereon.

The fusing device 60 can include a heating member 61 containing a heat source 62 and a pressure roller 63 to push the recording medium P toward the heating member 61.

The heat source 62 may be formed of a heat emitting element, such as a heater, a lamp, a hot wire and the like, to heat the heating member 61.

The heating member 62 may take the form of a roller containing the heat source 62 therein, or a belt to be heated by the heat source 62.

The pressure roller 63 is supported by an elastic member 65 so as to come into close contact with the heating member 61 with a constant fusing pressure between the pressure roller 63 and the heating member 61. If necessary, a plurality of pressure rollers 63 may be provided.

With this configuration, as the recording medium P passes between the heating member 61 and the pressure roller 63, the fusing device 60 applies heat and pressure to a visible image transferred to the recording medium P, thereby fusing the visible image to the recording medium P.

The paper discharge device 70 includes a first discharge roller 71 and a second discharge roller 73 arranged in sequence and serves to discharge the recording medium P having passed through the fusing device 60 to the outside of the main body 20.

The double-sided printing device 80 returns the recording medium P, on a surface of which the image has been completely formed, to the developing device 40 such that images are printed on both surfaces of the recording medium P.

The double-sided printing device 80 may include a double-sided printing guide 81 defining a return path of the recording medium P, and return rollers 83 installed on the return path of the recording medium P to deliver the recording medium P.

To perform a double-sided printing operation, the recording medium P, on a surface of which an image has been completely formed, is delivered by the second discharge roller 73 and is inverted at a particular position so as to be guided to the double-sided printing guide 81. Then, the recording medium P is again delivered to the developing device 40 by the return rollers 83 so as to sequentially pass through the developing device 40 and the fusing device 60, allowing an image to be formed on an opposite surface thereof.

The developing device 40 is arranged on a printing path S above the paper feeding device 30 and forms a developer image on the recording medium P delivered from the paper feeding device 30.

The developing device 40, as illustrated in FIG. 2, includes a housing 90 defining the external appearance of the developing device 40. The housing 90 accommodates major developing elements including the photoconductor 41, charging roller 42, developing roller 44 and feed roller 45 and may take the form of a single process cartridge.

The housing 90 may be divided into a developing unit 93 in which processing members to form an image on the recording medium P are installed, a developer feed unit 91 to feed developer to the developing unit 93, and a waste developer storage unit 94 in which waste developer collected from the developing unit 93 is stored.

Rotating members 92 may be arranged in the developer feed unit 91 to agitate the developer stored in the developer feed unit 91 and feed the developer toward the developing unit 93.

The developer feed unit 91 may be integrally formed with the developing unit 93, or may be separably coupled to the developing unit 93.

The developing unit 93 may be provided with the photoconductor 41, on which an electrostatic latent image is formed, the charging roller 42 to charge the photoconductor 41 with a predetermined electric potential, the developing roller 44 to develop the electrostatic latent image formed on the photoconductor 41 into a developer image, and the feed roller 45 to feed the developer from the developer feed unit 91 to the developing roller 44.

The photoconductor 41 may be a drum as an image carrier to carry a developer image.

When the light scanning device 50 irradiates a laser beam corresponding to image information to the photoconductor 41, an electrostatic latent image is formed on the surface of the photoconductor 41.

The charging roller 42 is rotated and comes into contact with the surface of the photoconductor 41 so as to charge the surface of the photoconductor 41 with a predetermined electric potential.

The developing roller 44 feeds the developer to the photoconductor 41 so as to develop the electrostatic latent image formed on the photoconductor 41 into a developer image.

The developing roller 44 may feed the developer to the photoconductor 41 in a contact or non-contact manner.

The feed roller 45 feeds the developer stored in the developer feed unit 91 to the developing roller 44.

The developer fed to the developing roller 44 forms a developer layer and a regulating member 96 may be provided to maintain a constant thickness of the developer layer.

With the above-described configuration, the light scanning device 50 forms an electrostatic latent image on the surface of the photoconductor 41 charged with a predetermined electric potential by the charging roller 42, and the electrostatic latent image is developed using the developer stored in the developer feed unit 91 by operation of the feed roller 45 and the developing roller 44. In this way, a visible image made with developer powder is formed on the photoconductor 41.

The main body 20 may further accommodate a transfer roller (46, see FIG. 1), which pushes the recording medium P toward the photoconductor 41 such that the visible image formed on the photoconductor 41 is transferred to the surface of the recording medium P.

The transfer roller 46 is arranged to come into contact with the photoconductor 41 of the developing device 40 when the developing device 40 is mounted in the main body 20.

As the recording medium P passes between the photoconductor 41 and the transfer roller 46, the visible image of the photoconductor 41 is transferred to the recording medium P by a developing nip.

The waste developer storage unit 94 may be provided with rotating members (not shown) to agitate or deliver the developer collected from the photoconductor 41 by a cleaning blade (not shown).

The waste developer storage unit 94 may be separably coupled to or integrally formed with the developing unit 93 of the housing 90.

In the above-described developing device 40 to form an image, a constant voltage is applied to the charging roller 42, and the charging roller 42, in contact with the photoconductor 41, is rotated by frictional contact force during rotation of the photoconductor 41, acting to charge the surface of the photoconductor 41. In this case, to maintain the charging roller 42 under constant pressure even when vibration by rotation of the photoconductor 41 occurs, the charging roller 42 is elastically supported by pressure members 110 which will be described hereinafter and thus, is under pressure against the photoconductor 41.

The developing device 40 may cause damage to the photoconductor 41 and the charging roller 42 due to a vibration or shock generated during transportation thereof and consequently, may cause image defects when forming images.

Therefore, the present embodiment may employ a member to provide a space between the photoconductor 41 and the charging roller 42 before the developing device 40 is mounted into the main body 20.

FIG. 3 is a perspective view illustrating the external appearance of the developing device in accordance with the present embodiment, FIG. 4 is an exploded perspective view illustrating a part of the developing unit of the developing device housing in accordance with the present embodiment, FIG. 5 is a partial enlarged view of FIG. 4, and FIG. 6 is an assembled sectional view of FIG. 5.

As illustrated in FIGS. 3 to 6, the developing device 40 includes holders 100 slidably coupled to the housing 90 so as to support the charging roller 42, the pressure members 110 to push the holders 100 toward the photoconductor 41, and a space maintaining member 130 to maintain a space between the photoconductor 41 and the charging roger 42.

The photoconductor 41 is rotatably supported at the bottom of the housing 90. The charging roller 42 to charge the photoconductor 41 is supported by the holders 100 and is slidably coupled to the housing 90.

The holders 100 are arranged at both ends of a rotating shaft 43 of the charging roller 42 to support the charging roller 42. Each holder 100 may include a body 102 provided with a shaft seat 101 to support the rotating shaft 43 of the charging roller 42, and a hook 103 extending from the body 102 in an opposite direction of the shaft seat 101.

The body 102 includes a pair of vertical portions 102*a* and 102*b* arranged to face each other, and a connecting portion 102*c* to connect the vertical portions 102*a* and 102*b* to each other. The vertical portions 102 and 102*b* may be provided at outer surfaces thereof with vertical guide grooves 104.

The shaft seat 101 is formed at a lower surface of the connecting portion 102*c* and a space to receive the pressure member 110 may be defined on an upper surface of the connecting portion 102*c*. A first support boss 105 may protrude from the upper surface of the connecting portion 102*c* to support one end of the pressure member 110.

The hook 103 may consist of a vertical bar 103*a* and a horizontal bar 103*b*. The vertical bar 103*a* vertically extends from the body 102 such that a part thereof protrudes outward from the housing 90 and the horizontal bar 103*b* extends perpendicular to a distal end of the vertical bar 103*a* so as to come into contact with the space maintaining member 130.

The hook 103 may have an approximately 'L'-shaped form so as to be supported on an upper surface of the space maintaining member 130 when the space maintaining member 130 is inserted between the horizontal bar 103*b* and an outer surface 90*b* of the housing 90.

The horizontal bar 103*b* may be provided with a downwardly inclined insertion guide surface 106 to guide introduction of the space maintaining member 130.

The housing 90 may be provided with a pair of guide ribs 140 to guide movement of each holder 100. The pair of guide ribs 140 extends downward from an inner surface 90*a* of the housing 90 and is arranged to face each other. The guide ribs 140 may be inserted into the vertical guide grooves 104 of the holder 100.

The guide ribs 140 may be provided at lower ends thereof with stoppers 141. The stoppers 141 protrude inward of the guide ribs 140 so as to prevent separation of the holder 100 when moving along the guide ribs 140.

The stoppers 141 may be positioned so as not to reduce elasticity of the pressure member 110 when the charging roller 42 and the photoconductor 41 come into contact with each other by the pressure member 110.

In this way, the holders 100 may be slidably coupled to the guide ribs 140 within the housing 90.

The housing 90 is provided at a position above the holder 100 with a slot 143 through which the hook 103 of the holder 100 penetrates when the holder 100 is moved upward toward the housing 90. The slot 143 may have a size corresponding to the horizontal bar 103*b* of the hook 103.

Thus, even when the space maintaining member 130 to support the holder 100 is removed, the slot 143 is covered by the horizontal bar 103*b*, which prevents introduction of foreign substances through the slot 143.

The pressure member 110 may include a compressive coil spring interposed between the holder 100 and the housing 90 so as to push the holder 100 toward the photoconductor 41. However, the pressure member is not limited to a compressive coil, and may include another type of device which provides the intended purposes as described herein.

One end of the pressure member 110 may be supported by the first support boss 105 of the holder 100 and the other end of the pressure member 110 may be supported by a second support boss 144 protruding from the inner surface 90*a* of the housing 90.

The space maintaining member 130 may include a cover 131 extending in a width direction of the developing device 40, intervening pieces 133 extending from both ends of the cover 131 and grippers 137 to allow a user to grip the space maintaining member 130 upon coupling or separation thereof.

The space maintaining member 130 is separably mounted to the outer surface 90*b* of the housing 90. When the space maintaining member 130 is mounted to the housing 90, the cover 131 covers an opening 47 of an optical path provided in the housing 90 and the intervening pieces 133 are fitted between the hooks 103 and the outer surface 90*b* of the housing 90.

The optical path is a path along which a beam irradiates from the light scanning device 50 and reaches the photoconductor 41, and also provides a communication path between the photoconductor 41 and the outside of the housing 90.

Thus, the space maintaining member 130 can serve to prevent damage to various interior elements of the housing 90 due to foreign substances that would otherwise be introduced through the opening 47 of the optical path during transportation of the developing device 40 and also, to prevent exposure damage to the photoconductor 41 caused when the photoconductor 41 is otherwise exposed to the outside for a long time.

Although the present embodiment illustrates the cover 131 as covering the entrance 47 of the optical path, as illustrated in FIG. 8, the space maintaining member 130 may further include a photoconductor cover 131*a* extending below the housing 90 to cover an opening through which the photoconductor 41 is exposed to the outside.

The intervening piece 133 may include a plate-shaped insertion rib 134 extending from either end of the cover 131 to have a predetermined thickness.

The insertion rib 134 is fitted between the hook 103 of the holder 100 protruding outward from the housing 90 and the outer surface 90*b* of the housing 90 and acts to lift the holder 100, allowing the charging roller 42 and the photoconductor 41 to be spaced apart from each other.

A thickness t of the insertion rib 134 may be appropriately changed based on design conditions because a distance between the charging roller 42 and the photoconductor 41 depends on the thickness t. That is, the insertion rib 134 may be a metallic plate to minimize the distance between the charging roller 42 and the photoconductor 41, instead of an injected molded article. The thickness of the insertion rib 134 may be determined to release only pressure applied by the pressure member 110 without causing the charging roller 42 and the photoconductor 41 to be completely spaced apart from each other, thereby maintaining the charging roller 42 and the photoconductor 41 in contact with each other.

The insertion rib 134 may be made of a highly rigid material to prevent deformation or damage due to pressure applied to the pressure member 110.

A downwardly inclined slope 135 may be provided at a tip end of the insertion rib 134 to allow a smooth insertion of the insertion rib 134 between the hook 103 and the outer surface 90*b* of the housing 90. The slope 135 slides in contact with the insertion guide surface 106 of the hook 103.

The insertion rib 134 is configured to support the holder 100 used to support the charging roller 42 from the outside of the housing 90. This allows the user to conveniently confirm whether the charging roller 42 and the photoconductor 41 are spaced apart from each other at the outside of the housing 90.

In addition, since the insertion rib 134 is interposed between the hook 103 and the housing 90 and thus, has an increased contact area with both members, it is possible to effectively disperse force against the weight of the charging roller 42 and the pressure of the pressure member 110, which may reduce damage due to vibration and shock or a long storage time.

Also, as a result of providing the space maintaining member 130 used to maintain a space between the photoconductor 41 and the charging roller 42 at the outside of the housing 90, it is possible to prevent the space maintaining member 130 from coming into direct contact with the photoconductor 41 and the charging roller 42, which may prevent damages such as scratches or spots.

The grippers 137 are provided at both ends of the cover 131 at an opposite side of the cover 131 from which the intervening pieces 133 are provided. For user convenience, the grippers 137 may extend in a direction in which the space maintaining member 130 is separated.

Although the present embodiment illustrates the intervening pieces 133 of the space maintaining member 130 as taking the form of plates having a predetermined thickness, the shape of the intervening pieces 133 is not limited so long as they can lift the holders 100 in an opposite direction of a pressure application direction of the pressure members 100. For example, as illustrated in FIG. 7, the intervening pieces 133 may include rod members 138 having a circular cross section, and the hooks 103 of the holders 100 may be provided with through-holes 107 for insertion of the rod members 138. In this case, as the holders 100 are moved by the space maintaining member 130 in a state in which the rod members 138 are inserted into the through-holes 107, the photoconductor 41 and the charging roller 42 are spaced apart from each other.

Hereinafter, operation of the developing device in accordance with the present embodiment will be described.

FIG. 9 is a view illustrating a state in which the space maintaining member is mounted on the developing device housing in accordance with the embodiment, and FIG. 10 is a view illustrating a state in which the space maintaining member is separated from the developing device housing in accordance with the embodiment.

First, in a state in which the charging roller 42 supported by the holders 100 is pushed toward the photoconductor 41 by pressure of the pressure members 110, the space maintaining member 130 is mounted to the outer surface 90*b* of the housing 90.

When the space maintaining member 130 is mounted to the housing 90, the cover 131 of the space maintaining member 130 covers the opening 47 of the optical path of the housing 90 and the intervening pieces 133 are inserted between the hooks 103 of the holders 100 and the outer surface 90*b* of the housing 90.

Once the intervening pieces 133 are inserted, the holders 100, which have moved toward the photoconductor 41 by pressure of the pressure members 110, are spaced apart from the photoconductor 41 by a distance equal to the thickness of the intervenient pieces 133. In this case, although pressure applied to the holders 100 by the pressure members 110 are maintained, the intervenient pieces 133 serve as stoppers, preventing the holders 100 from moving toward the photoconductor 41.

Thereafter, since the photoconductor 41 and the charging roller 42 are spaced apart from each other during transportation of the developing device 40, the photoconductor 41 and the charging roller 42 can be protected from friction and/or shock damage. In addition, the space maintaining member 130 of the present embodiment includes the cover 131 to cover the opening 47 of the housing 90 and thus, prevents foreign substances from entering the housing 90 through the opening 47.

If the user separates the space maintaining member 130 from the housing 90 in order to mount the developing device 40 into the main body 20, the intervening pieces 133 used to prevent movement of the holders 100 are removed, causing the holders 100 to be moved toward the photoconductor 41 by pressure of the pressure members 110. In this way, the charging roller 42 supported by the holders 100 is moved along with the holders 100 and comes into contact with the photoconductor 41. Thereafter, the photoconductor 41 and the charging roller 42 maintain a constant pressure therebetween as a result of the pressure provided by the pressure members 110.

With the above-described operation, it is possible to prevent damage or contamination during transportation of the developing device 40 and to improve image quality. In addition, the space maintaining member 130 of the present embodiment is located at the outside of the housing 90, which simplifies an operation to maintain a space between the photoconductor 41 and the charging roller 42 and to prevent damages such as scratches due to direct contact with the photoconductor 41 or the charging roller 42.

Further, since the space maintaining member 130 is supported by both the hooks 103 of the holders 100 and the housing 90, the space maintaining member 130 is free from damage due to deformation even if it is kept assembled for a long time.

As is apparent from the above description, according to the embodiments, prior to being mounted into a main body of an image forming apparatus, a developing device remains in a state in which a photoconductor is spaced apart from a charging roller, which may prevent deformation of the charging roller despite a long storage time thereof.

Further, a space maintaining member in accordance with the embodiments does not need to be accommodated in the developing device, which can therefore assure enhanced assembly convenience and less deformation despite a long storage time.

Furthermore, the space maintaining member in accordance with the embodiments may prevent invasion of foreign substances and exposure damage to the photoconductor owing to a cover used to intercept an optical path, resulting in enhanced reliability.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing device comprising:

a housing;

a photoconductor supported by the housing;

a charging roller to charge the photoconductor;

a holder slidably installed to the housing and serving to support the charging roller;

a pressure member to apply pressure to the holder toward the photoconductor; and a space maintaining member separably installed to an outer surface of the housing and having an intervening piece configured to be fitted between the holder and the housing and disposed on the outer surface of the housing to engage with a portion of the holder protruding outward from the housing so as to cause the photoconductor and the charging roller to be spaced apart from each other.

2. The developing device according to claim 1, wherein:

the housing includes an optical path along which a beam irradiated from a light scanning device reaches the photoconductor; and the space maintaining member includes a cover to cover an opening in the housing in which the optical path extends.

3. The developing device according to claim 1, wherein the charging roller comes into contact with the photoconductor by the pressure of the pressure member when the space maintaining member is separated from the housing.

4. The developing device according to claim 2, wherein the holder includes a hook protruding outward from the housing, and the intervening piece is fitted between the hook and the housing.

5. The developing device according to claim 3, wherein the pressure member includes a compressive coil spring interposed between the housing and the holder.

6. The developing device according to claim 3, wherein the intervening piece takes the form of a plate having a predetermined thickness to adjust a distance between the charging roller and the photoconductor.

7. The developing device according to claim 4, wherein the intervening piece includes an insertion rib extending from the cover, and a slope is formed at a tip end of the insertion rib.

8. The developing device according to claim 7, wherein the hook includes a downwardly inclined insertion guide surface to guide insertion of the insertion rib.

9. The developing device according to claim 1, wherein a guide rib is provided inside the housing such that the holder is slidably coupled to the guide rib, and a stopper is formed at an end of the guide rib to prevent separation of the holder.

10. The developing device according to claim 9, wherein:

the holder includes a body provided with a shaft seat to support the charging roller, guide grooves formed in opposite sides of the body such that the guide ribs are fitted into the guide grooves, and a hook extending from the body in an opposite direction of the shaft seat; and the intervenient piece is fitted between the housing and the hook.

11. The developing device according to claim 10, wherein:

the body includes a support boss on which the pressure member is seated and supported; and the pressure member includes a compressive coil spring having one end supported by the support boss and the other end supported by the housing.

12. The developing device according to claim 2, wherein the space maintaining member includes a gripper to allow a user to grip the space maintaining member upon coupling or separation thereof.

13. The developing device according to claim 2, wherein the housing includes an opening through which a part of the photoconductor is exposed, and the space maintaining member further includes a photoconductor cover to cover the opening.

14. The developing device according to claim 3, wherein the holder includes a hook protruding outward from the housing and having a through-hole, and the intervening piece is inserted into the through-hole.

15. The developing device according to claim 14, wherein the intervening piece includes a rod member having a circular cross section.

16. An image forming apparatus comprising:

a main body; and a developing device separably accommodated in the main body and including a housing in which a photoconductor and a charging roller arranged to come into contact with the photoconductor so as to charge the photoconductor with a predetermined electric potential are accommodated, wherein the developing device includes:

a holder slidably installed to the housing and serving to support the charging roller;

a pressure member to apply pressure to the holder toward the photoconductor; and a space maintaining member separably installed to an outer surface of the housing and having an intervenient piece configured to be fitted between the holder and the housing and disposed on the outer surface of the housing to engage with a portion of the holder protruding outward from the housing so as to cause the photoconductor and the charging roller to be spaced apart from each other, and wherein the charging roller comes into contact with the photoconductor by the pressure of the pressure member when the space maintaining member is separated from the housing.

17. A developing device comprising:

a housing;

a photoconductor rotatively supported within the housing;

a holder assembly to hold a charging roller and slidably supported within the housing to slidably move the charging roller toward and away from the photoconductor, the holder assembly including a portion which extends through a slot in the housing when spaced away from the photoconductor;

at least one pressure member disposed between the holder assembly and an inner portion of the housing to press the holder assembly toward the photoconductor such that the charging roller makes contact with the photoconductor; and a space maintaining member comprising an intervening piece which engages with the portion of the holder assembly extending outside of the housing through the slot to prevent the holder assembly from being pressed toward the photoconductor.

* * * * *